US008123502B2

(12) United States Patent
Blakey et al.

(10) Patent No.: US 8,123,502 B2
(45) Date of Patent: Feb. 28, 2012

(54) ACOUSTIC PUMP UTILIZING RADIAL PRESSURE OSCILLATIONS

(75) Inventors: David Mark Blakey, Herts (GB); John Matthew Somerville, Herts (GB); James Edward McCrone, Cambridge (GB); Justin Rorke Buckland, Cambridge (GB)

(73) Assignee: The Technology Partnership plc, Melbourne, Royston, Hertfordshire (GB)

( * ) Notice: Subject to any disclaimer, the term of this patent is extended or adjusted under 35 U.S.C. 154(b) by 1110 days.

(21) Appl. No.: 11/918,796

(22) PCT Filed: Apr. 21, 2006

(86) PCT No.: PCT/GB2006/001487

§ 371 (c)(1), (2), (4) Date: Dec. 12, 2007

(87) PCT Pub. No.: WO2006/111775

PCT Pub. Date: Oct. 26, 2006

(65) Prior Publication Data

US 2009/0087323 A1 Apr. 2, 2009

(30) Foreign Application Priority Data

Apr. 22, 2005 (GB) ..... 0508194.8

(51) Int. Cl.
*F04B 45/04* (2006.01)
*F04B 45/047* (2006.01)
*F04B 25/00* (2006.01)

(52) U.S. Cl. ..... 417/413.1; 417/413.2; 92/96

(58) Field of Classification Search ..... 417/412, 417/413.1, 413.2, 479; 92/96
See application file for complete search history.

(56) References Cited

U.S. PATENT DOCUMENTS

| | | | | |
|---|---|---|---|---|
| 5,769,608 | A * | 6/1998 | Seale | 417/53 |
| 6,203,291 | B1 | 3/2001 | Stemme et al. | |
| 2004/0000843 | A1 | 1/2004 | East | |

FOREIGN PATENT DOCUMENTS

| | | |
|---|---|---|
| WO | 93/10910 | 5/1993 |

* cited by examiner

*Primary Examiner* — Devon C Kramer
*Assistant Examiner* — Philip Stimpert

(57) ABSTRACT

A fluid pump comprising one or more actuators, two end walls, a side wall; a cavity which, in use, contains fluid, the cavity having a substantially cylindrical shape bounded by the end walls and the side walls, at least two apertures through the cavity walls, at least one of which is a valved aperture, wherein the cavity radius, a, and height, h, satisfy the following inequalities: a/h is greater than 1.2; and $h^2/a$ is greater than $4\times10^{-10}$ m; and wherein, in use, the actuator causes oscillatory motion of one or both end walls in a direction perpendicular to the plane of the end walls; whereby, in use, the axial oscillations of the end walls drive radial oscillations of fluid pressure in the cavity.

17 Claims, 4 Drawing Sheets

ACOUSTIC PUMP UTILIZING RADIAL PRESSURE OSCILLATIONS

This invention relates to a pump for a fluid and, in particular, to a pump in which the pumping cavity is substantially cylindrical in shape, but is sized such that the aspect ratio is large, i.e. the cavity is disk-shaped.

The generation of high amplitude pressure oscillations in closed cavities has received significant attention in the fields of thermoacoustics and pump/compressors. Recent developments in non-linear acoustics have allowed the generation of pressure waves with higher amplitudes than previously thought possible.

It is known to use acoustic resonance to achieve fluid pumping from defined inlets and outlets. This can be achieved using a cylindrical cavity with an acoustic driver at one end, which drives an acoustic standing wave. In such a cylindrical cavity, the acoustic pressure wave has limited amplitude. Varying cross-section cavities, such as cone, horn-cone, bulb have been used to achieve high amplitude pressure oscillations thereby significantly increasing the pumping effect. In such high amplitude waves the non-linear mechanisms with energy dissipation have been suppressed. However, high amplitude acoustic resonance has not been employed within disk-shaped cavities in which radial pressure oscillations are excited.

A linear resonance compressor is also known in which the mass of the drive armature and spring force of a steel diaphragm combine to provide a mechanically resonant drive to the air cavity. This drive is coupled to a cylindrical cavity of diameter between 4 and 15 cm (depending on the design of the compressor) through a steel diaphragm, which is capable of up to 1.5 mm displacement in use. The drive frequency is set to between 150 and 300 Hz by the mechanical resonance. At this frequency, the radial acoustic wavelength is much longer than the cavity radius. Therefore it can be deduced that radial pressure oscillations are not employed in this cavity pump. The low frequency drive mechanism used in this linear resonance compressor incorporates an electromechanical armature, leaf spring suspension, noise enclosure, and vibration mount suspension. This leads to a large overall size of the compressor.

The present invention aims to overcome one or more of the above identified problems.

According to the present invention, there is provided a fluid pump comprising:

one or more actuators;

two end walls;

a side wall;

a cavity which, in use, contains fluid, the cavity having a substantially cylindrical shape bounded by the end walls and the side walls;

at least two apertures through the cavity walls, at least one of which is a valved aperture;

wherein the cavity radius, a, and height, h, satisfy the following inequalities;

$$\frac{a}{h} > 1.2; \text{ and}$$

$$\frac{h^2}{a} > 4\times10^{-10} \text{ m; and}$$

wherein the actuator causes oscillatory motion of one or both end walls in a direction substantially perpendicular to the plane of the end walls;

whereby, in use, the axial oscillations of the end walls drive radial oscillations of fluid pressure in the cavity.

$$\frac{h^2}{a}$$

should be greater than $4\times10^{-10}$ m when pumping a liquid, but in the case of pumping a gas, it is preferable that the ratio is greater than $1\times10^{-7}$ m.

Given the relationships between cavity radius and height above, the present invention provides a substantially disk-shaped cavity having a high aspect ratio.

The invention can be thought of as an acoustic pump, in that an acoustic resonance is set up within the cavity. However, the driver velocity, typically of the order of 1 $ms^{-1}$, is amplified by the geometry of the cavity to give an effective drive velocity far exceeding this value, producing a very high acoustic pressure. Correspondingly, the high pressure may be seen as arising from the inertial reaction of the air (the air's resistance to motion) to the high acceleration imposed upon it by the combination of the actuator movement and the cavity geometry.

An important difference between the present invention and known cylinder and conical pumps is the contribution of the resonance to the pressure in the cavity. Known cylinder and cone pumps rely on a high Q factor (strong resonance) to achieve high pressures, making them very sensitive to the tuning of the actuator and cavity resonances. However, the present invention operates at a much lower Q value and is therefore less sensitive to small shifts in resonance resulting from temperature fluctuations or changes in pump load.

The present invention overcomes the large size of known linear resonance compressors by replacing the low frequency drive mechanism with a disk actuator, preferably piezoelectric. This disk is typically less than 1 mm thick and is tuned to operate at more than 500 Hz, preferably 10 kHz, more preferably 20 kHz or higher. A frequency of approximately 20 kHz or above provides operation above the threshold of normal human hearing, thereby removing the need for a noise enclosure. Preferably, in use, the frequency of the oscillatory motion is within 20% of the lowest resonant frequency of radial pressure oscillations in the cavity. More preferably, the frequency of the oscillatory motion is, in use, equal to the lowest resonant frequency of radial pressure oscillations in the cavity. Furthermore, the high frequency of the present invention significantly reduces the size of the cavity and the overall device. Accordingly, the present invention can be constructed with a cavity volume of less than 10 ml, making it ideally suited to micro-device applications. A disk provides a low cavity volume and a geometric form able to sustain high amplitude pressure oscillations.

It is preferable that the end walls defining the cavity are substantially planar and substantially parallel. However, the terms "substantially planar" and "substantially parallel" are intended to include frusto-conical surfaces such as those shown in FIGS. 5A and 5B as the change in separation of the two end walls over a typical diameter of 20 mm is typically no more than 0.25 mm. As such, the end walls are substantially planar and substantially parallel.

In a preferred example, the ratio of the cavity radius to its height is greater than 20, such that the cavity formed is a disk shape, similar to that of a coin or such like. By increasing the aspect ratio of the cavity, the acoustic pressure generated by the motion of the end wall(s) is significantly increased.

In particular, when the cavity radius is greater than 1.2 times the height of the cavity, i.e.

$$\frac{a}{h} > 1.2,$$

the lowest frequency acoustic mode becomes radial, rather than longitudinal.

The body of the cavity is preferably less than 10 ml and the lowest resonant frequency of the radial fluid pressure oscillations in the cavity is most preferably greater than 20 kHz when the pump is in operation.

One or both of the end walls that define the cavity may have a frusto-conical shape, such that the end walls are separated by a minimum distance at the centre and by maximum distance at the edge. The end walls are preferably circular, but may be any suitable shape.

The perimeter of the end walls may be elliptical in shape.

The actuator may be a piezoelectric device, a magnetostrictive device or may include a solenoid which, upon actuation drives a piston to drive one of the end walls of the cavity.

Either one or both end walls are driven. In the example where both end walls are driven, it is preferable that the motion of the opposite walls is 180° out of phase. The motion of the driven walls is in a direction substantially perpendicular to the plane of the end walls.

In use, the amplitude of the motion of the driven end wall(s) matches closely the profile of the pressure oscillation in the cavity. In this case, we describe the actuator and cavity as being mode-shape matched. For a disc shaped cavity, the profile of the pressure oscillation is approximately a Bessel function. Therefore the amplitude of the motion of the driven end wall(s) is at a maximum at the centre of the cavity. In this case the net volume swept by the cavity wall is much less than the cavity volume and so the pump has a low compression ratio.

Any valved apertures which are provided in the cavity walls are preferably located near the centre of the end walls. It is not important whether the valved aperture is the inlet or the outlet, but it is essential that at least one of the apertures is controlled by a valve. Any unvalved apertures are preferably located on a circle, the radius of which is 0.63a, as this is the location of the minimum pressure oscillation in the cavity. The unvalved apertures may be within 0.2a of the 0.63a radius circle. The valved apertures should be located near the centre of the cavity, as this is the location of maximum pressure oscillation. It is understood that the term "valve" includes both traditional mechanical valves and asymmetric nozzle(s), designed such that their flow restriction in forward and reverse directions is substantially different.

It is possible to combine two or more pumps, either in series or in parallel. It is also possible to combine two pumps such that they are separated by a common cavity end wall. Such a common end wall may be formed by actuator, in which case both pumps are powered by the same actuator.

Examples of the present invention will now be described with reference to the accompanying drawings, in which:

FIG. 1 is a schematic vertical cross-section through one example according to the present invention;

FIGS. 2A to D show different arrangements of valved and unvalved apertures;

Figure 1:
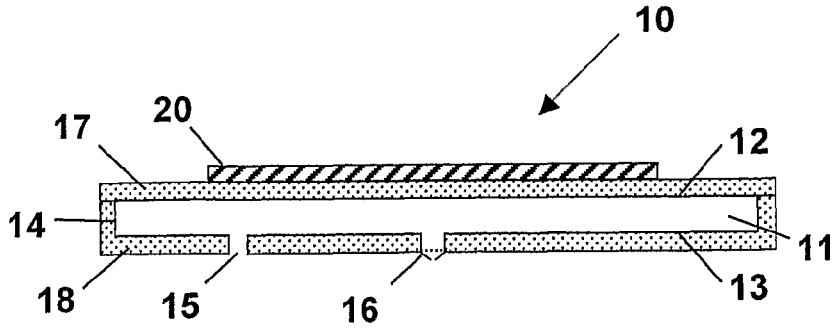

FIG. 1 shows a schematic representation of a pump 10 according to the present invention. A cavity 11 is defined by end walls 12 and 13, and a side wall 14. The cavity is substantially circular in shape, although elliptical and other shapes could be used. The cavity 11 is provided with a nodal air inlet 15, which in this example is unvalved although, as shown in FIGS. 2A to 2D, it could be valved and located substantially at the centre of the end wall 13. There is also a valved air outlet 16 located substantially at the centre of end wall 13. The upper end wall 12 is defined by the lower surface of a disc 17 attached to a main body 18. The inlet and outlet pass through the main body 18.

The actuator comprises a piezoelectric disc 20 attached to a disc 17. Upon actuation, the actuator is caused to vibrate in a direction substantially perpendicular to the plane of the cavity, thereby generating radial pressure oscillations within the fluid in the cavity. The oscillation of the actuator is further described with regard to FIGS. 3A, 3B and 4.

Figure 2:
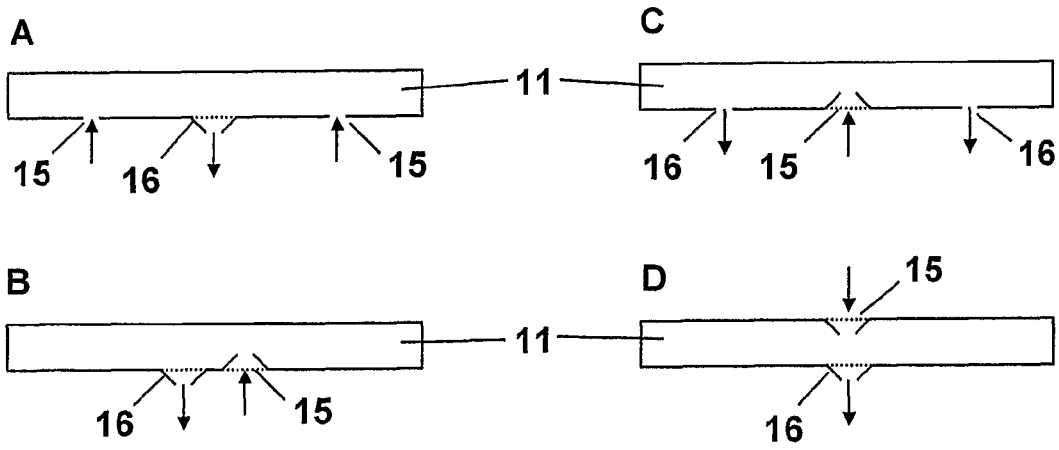

FIGS. 2A to D show different arrangements of valved and unvalved apertures leading into and out of cavity 11. In FIG. 2A, two inlet apertures 15 are unvalved and these are located at a point on a circle whose centre is the centre of the end wall 13 and whose radius is 0.63a. A valved outlet 16 is located at the centre of the end wall 13.

In FIG. 2B, both the inlet 15 and outlet 16 apertures are valved and are located as close as possible to the centre of the lower end wall 13. FIG. 2D shows an example whereby the valved inlet 15 and outlet 16 apertures are located in the upper 12 and lower 13 end walls respectively such that they are both at the centre of the respective end wall.

FIG. 2C shows an arrangement whereby the inlet aperture is valved and is located at the centre of end wall 13 and two outlet apertures are provided at 0.63a away from the centre of the end wall 13 and are unvalved.

Figure 3:
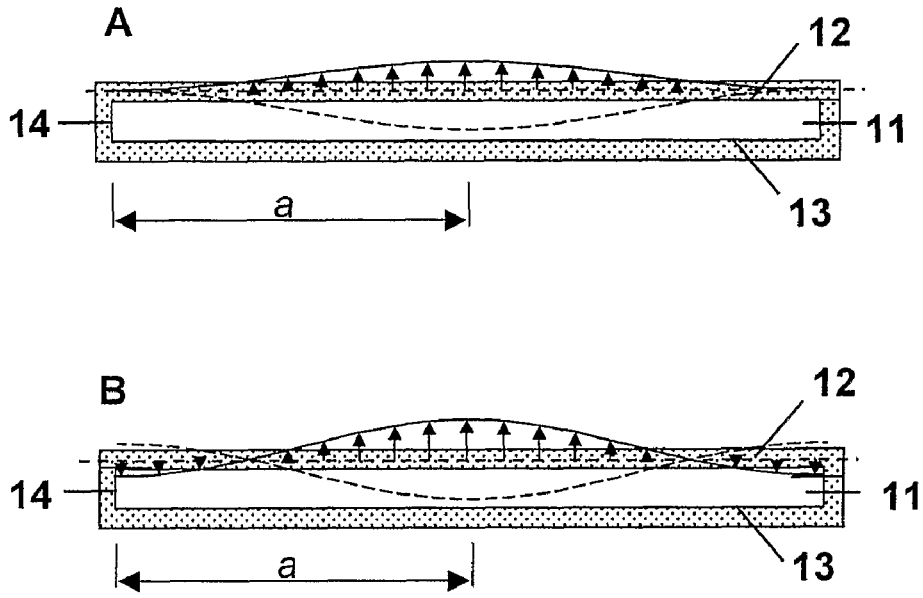
FIGS. 3A and 3B show displacement profiles of driven cavity end walls.

FIG. 3A shows one possible displacement profile of the driven wall 12 of the cavity. In this case the amplitude of motion is at a maximum at the centre of the cavity and at a minimum at its edge. The solid curved line and arrows indicate the wall displacement at one point in time and the dashed curved line its position one half cycle later. The displacements as drawn are exaggerated.

FIG. 3B shows a preferable displacement profile of the driven wall 12, namely a Bessel function having the following characteristics:

$$u(r) = J_0\left(\frac{k_0 r}{a}\right);\ k_0 \approx 3.83$$

In this case, as the centre of the driven end wall 12 moves away from the opposite end wall 13, the outer portion of the driven end wall 12 is caused to move towards the opposite end wall 13. In this case, the driven end wall and pressure oscillation in the cavity are mode-shape matched and the volume of the cavity 11 remains substantially constant.

Figure 4:
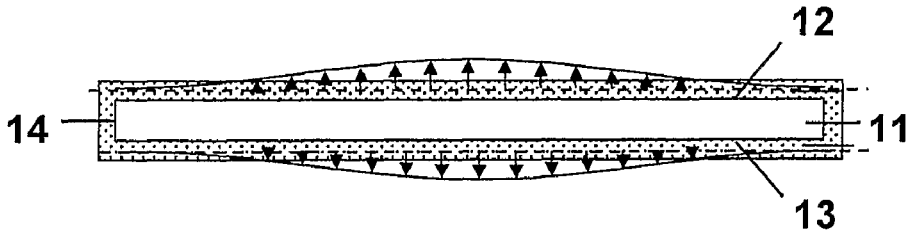
FIG. 4 shows a pump having both upper and lower end walls driven.

In FIGS. 3A and 3B, only the upper end wall 12 is driven and the arrows show the oscillatory motion of that end wall 12. In FIG. 4, the arrows indicate that both the upper 12 and lower 13 end walls are driven, such that their motion is 180° out of phase.

Figure 5:
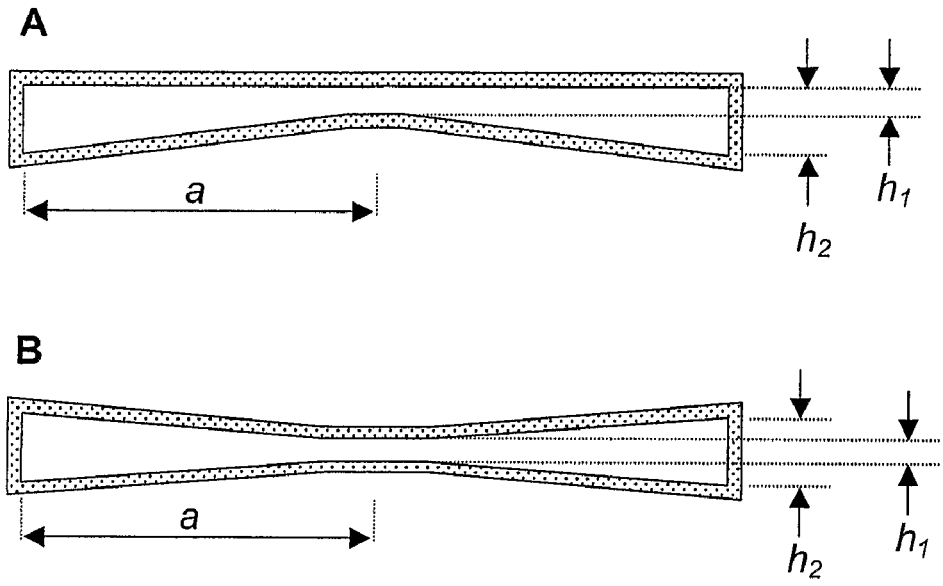
FIGS. 5A and 5B show tapered cavities.

FIGS. 5A and 5B illustrate a tapered cavity in which one (FIG. 5A) or both (FIG. 5B) end walls are frusto-conical in shape. It will be seen how the cavity 11 has a greater height at the radial extremes, whereas at the centre, the distance between the end walls is at a minimum. Such a shape provides an increased pressure at the centre of the cavity. Typically, the diameter of the cavity is 20 mm and $h_1$ is 0.25 mm and $h_2$ is 0.5 mm. As such, it will be appreciated how the end walls 12 and 13 are still substantially planar and substantially parallel according to the definition stated above.

Figure 6:
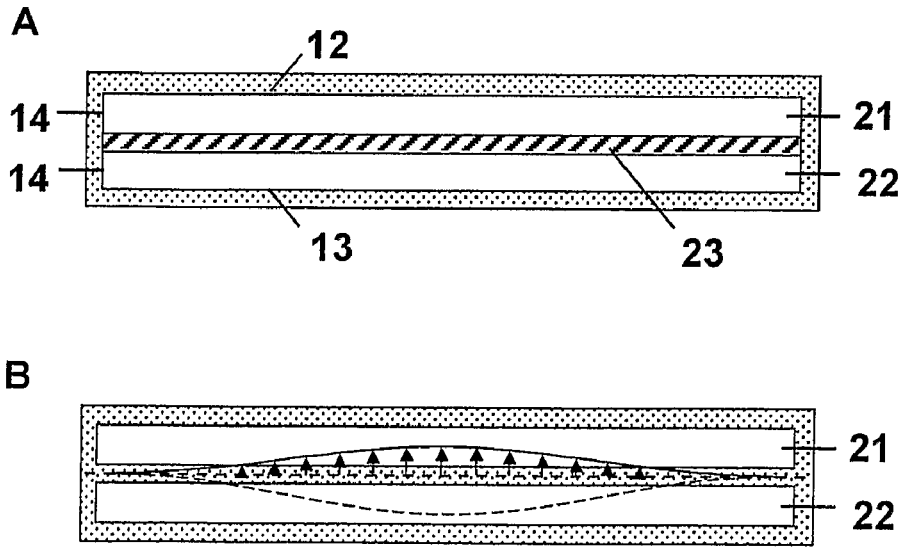
FIGS. 6A and 6B show a schematic and displacement profile of a two-cavity pump where the cavities share a common end wall.

FIG. 6A shows a two-cavity pump in which the cavities share a common end-wall. In this case a first cavity 21 is separated from a second cavity 22 by an actuator 23. The first cavity is defined by end-wall 12 and side-wall 14, with the other end-wall being one surface of actuator 23. The second cavity is defined by end-wall 13, side-wall 14, and the opposite surface of actuator 23. In this arrangement both cavities are driven simultaneously by the single actuator 23. FIG. 6B shows one possible displacement profile of the actuator 23. The positions of inlets and outlets have been omitted from FIGS. 6A and 6B for clarity.

Figure 7:
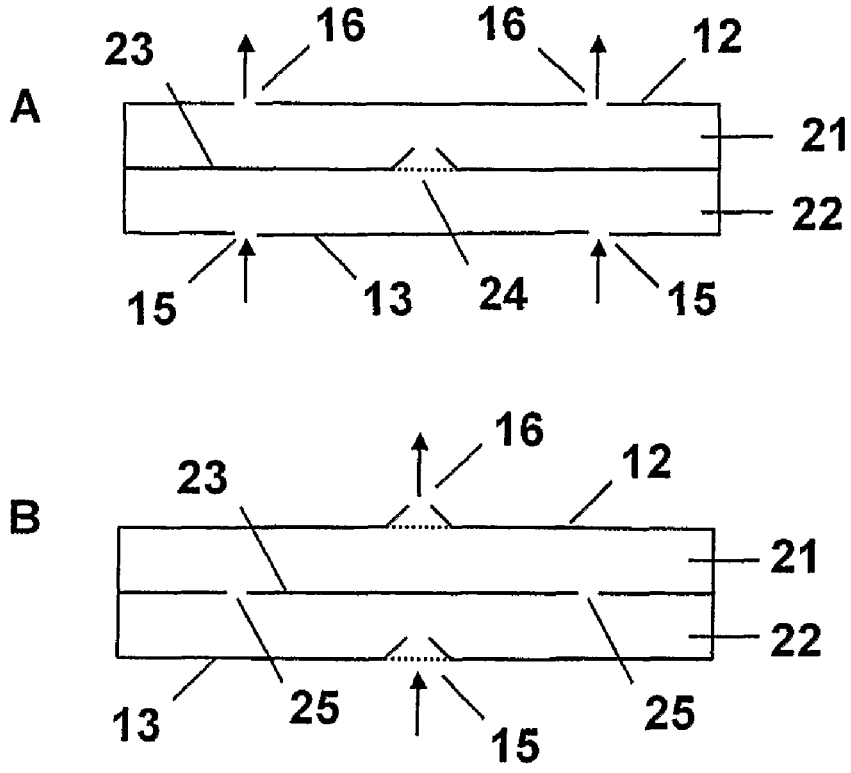
FIGS. 7A and 7B show different arrangements of valved and unvalved apertures for the two-cavity pump of FIGS. 6A and 6B.

FIGS. 7A and 7B show different arrangements of valved and unvalved apertures leading into and out of cavities 21 and 22 for the two-cavity pump shown in FIGS. 6A and 6B. In FIG. 7A, two pump inlet apertures 15 are provided at 0.63 times the radius of cavity 22 away from the centre of the end wall 13 and are unvalved. Two pump outlet apertures 16 are provided at 0.63 times the radius of cavity 21 away from the centre of the end wall 12 and are unvalved. The cavities 21 and 22 are connected by a valved aperture 24 provided at the centre of the actuator 23.

In FIG. 7B a valved pump inlet 15 is provided at the centre of end-wall 13, and a valved pump outlet 16 is provided at the centre of end-wall 12. The cavities 21 and 22 are connected by unvalved apertures 25 provided at 0.63 times the radius of cavities 21 and 22.

The radius a of the cavity 11 is related to the resonant operating frequency f by the following equation:

$$a \cdot f = \frac{k_0 c}{2\pi},$$

where c is the speed of sound in the working fluid.

For most fluids, $70\ ms^{-1} < a.f < 1200\ ms^{-1}$, corresponding to $115\ ms^{-1} < c < 1970\ ms^{-1}$. In use, pressure oscillations within the cavity are driven by the piezoelectric actuator which causes oscillatory motion of one or both of the flat end walls. Either a pair of valves (inlet and outlet) or a single outlet valve and a nodal inlet aperture are used to generate a pumped flow.

The choice of h and a determines the frequency of operation of the pump. The pressure generated is a function of the geometric amplification factor α, the resonant cavity Q-factor, the actuator velocity v, the density of the fluid ρ, and the speed of sound in the fluid c.

The geometric amplification factor α is given by:

$$\alpha = \frac{a}{2h}$$

Therefore, in order for the geometric amplification to be greater than 10, $$h < \frac{a}{20}.$$

The viscous boundary layer thickness δ is given by:

$$\delta = \sqrt{\frac{2\mu}{\rho \cdot 2\pi f}}$$

Where μ is the viscosity of the fluid. In order for the viscous boundary layer to be less than half the cavity thickness $$h > 2\sqrt{\frac{2\mu}{\rho \cdot 2\pi f}} = \sqrt{\frac{8\mu.a}{\rho \cdot k_0 c}}$$

With reference to FIG. 1, the displacement of the driven wall 12 depends on the actuator velocity v and its frequency f, and must be less than the cavity thickness, giving:

$$h < \frac{v}{2\pi f} \therefore h < \frac{va}{k_0 c}$$

In the case where both the upper and lower cavity walls are driven 1800 out of phase, the maximum actuator displacement is half this value.

Many applications require a small pump and therefore small cavity volume V:

$$V = \pi a^2 h$$

The following design criteria are important to the preferred values for optimum operation are as follows:

cavity resonant frequency—preferably >500 Hz, geometric amplification factor—preferably >10, viscous boundary layer thickness—preferably less than half the cavity thickness, cavity wall displacement must be less than the cavity thickness, and cavity volume—preferably less than 1 $cm^3$.

The invention claimed is:

1. A fluid pump comprising:

one or more actuators;

two end walls;

a side wall;

a cavity which, in use, contains fluid, the cavity having a substantially cylindrical shape bounded by the end walls and the side wall;

at least two apertures through the cavity walls, at least one of which is a valved aperture;

wherein the cavity radius, a, and height, h, satisfy the following inequalities:

$$\frac{a}{h}$$

is greater than 1.2; and $$\frac{h^2}{a}$$

is greater than $4\times10^{-10}$ m; and wherein, in use, the one or more actuators cause oscillatory motion of one or both end walls in a direction substantially perpendicular to the plane of the end walls;

whereby, in use, the axial oscillations of the end walls drive radial oscillations of fluid pressure in the cavity;

wherein the cavity radius, a, also satisfies the following inequality:

$$\frac{k_0 \cdot \text{c_min}}{2\pi f} < a < \frac{k_0 \cdot \text{c_max}}{2\pi f},$$

where c_min is 115 m/s, c_max is 1970 m/s, f is the operating frequency and $k_0$ is a constant ($k_0$=3.83); and wherein, in use, the motion of the driven end wall(s) and the pressure oscillations in the cavity are mode-shape matched and the frequency of the oscillatory motion is within 20% of the lowest resonant frequency of radial pressure oscillations in the cavity.

2. A pump according to claim 1, wherein the ratio $$\frac{a}{h}$$

is greater than 20.

3. A pump according to either claim 1 or claim 2, wherein the volume of the cavity is less than 10 ml.

4. A pump according to claim 1, wherein, in use, the frequency of the oscillatory motion is equal to the lowest resonant frequency of radial pressure oscillations in the cavity.

5. A pump according to claim 1, wherein, in use, the lowest resonant frequency of radial fluid pressure oscillations in the cavity is greater than 500 Hz.

6. A pump according to claim 1, wherein one or both of the end walls have a frusto-conical shape such that the end walls are separated by a minimum distance at the centre and by a maximum distance at the edge.

7. A pump according to claim 1, wherein the actuator is a piezoelectric device.

8. A pump according to claim 1, wherein the actuator is a magnetostrictive device.

9. A pump according to claim 1, wherein the actuator includes a solenoid.

10. A pump according to claim 1, wherein the amplitude of end wall motion approximates the form of a Bessel function.

11. A pump according to claim 1, wherein any unvalved apertures in the cavity walls are located at a distance of 0.63a plus or minus 0.2a from the centre of the cavity, where a is the cavity radius.

12. A pump according to claim 1, wherein any valved apertures in the cavity walls are located near the centre of the end walls.

13. A pump according to claim 1, wherein the ratio $$\frac{h^2}{a}$$

is greater than $10^{-7}$ meters and the working fluid is a gas.

14. A pair of pumps according to claim 1, wherein the cavity comprises two pump cavities that are separated by a common cavity end wall.

15. A pair of pumps according to claim 14, wherein the common cavity end wall is formed by an actuator.

16. A pair of pumps according claim 1, wherein the pumps are connected in series or in parallel.

17. A pump for moving a fluid from an input to an output, comprising:

a body having a substantially cylindrical sidewall and two end walls, each of the end walls closing one end of the sidewall to form a cylinder therein having a radius (a) and a height (h);

an actuator responsive to a source of energy to provide a mechanical displacement oscillating at a frequency (f) and disposed in mechanical communication with one of the end walls for displacing the end wall in a substantially axial direction oscillating at the frequency (f) of the source;

at least two apertures extending through the end walls and functioning as the input and output of said pump with at least one of the apertures being about 0.63(a)±0.2(a) from the center of one of the end walls;

a valve disposed within at least one of the apertures to close and open in response to the oscillating motion;

wherein the radius (a) and height (h) of the cylinder are related to each other and the frequency (f) of the source by the following equations:

$$\frac{a}{h} > 1.2, \text{ and}$$

$$\frac{h^2}{a} > 4\times10^{-10} m, \text{ and}$$

$$\frac{k_0 c_{slow}}{2\pi f} \le a \le \frac{k_0 c_{fast}}{2\pi f},$$

where $c_{slow}$≈115 m/s, $c_{fast}$≈1970 m/s, $k_o$≈3.83, and whereby, the oscillating end wall creates radial oscillations of fluid pressure in the cylinder to move the fluid from the input to the output of the pump in response to application of the energy source to said actuator.

* * * * *